166-66 SR
3/21/78 XR 4,079,784

United States Patent [19]
Howard et al.
[11] 4,079,784
[45] Mar. 21, 1978

[54] METHOD FOR IN SITU COMBUSTION FOR ENHANCED THERMAL RECOVERY OF HYDROCARBONS FROM A WELL AND IGNITION SYSTEM THEREFOR

[75] Inventors: Curtis E. Howard, Humble; Douglas G. Calvin; Robert W. Pitts, Jr., both of Houston, all of Tex.

[73] Assignee: Texaco Inc., New York, N.Y.

[21] Appl. No.: 669,127

[22] Filed: Mar. 22, 1976

[51] Int. Cl.[2] ..... E21B 43/24

[52] U.S. Cl. ..... 166/251; 166/53; 166/59; 166/64; 166/66; 166/302; 166/256

[58] Field of Search ..... 166/59, 66, 57, 302, 166/256, 260, 261, 53, 64, 65 R

[56] References Cited

U.S. PATENT DOCUMENTS

| | | | |
|---|---|---|---|
| 2,668,592 | 2/1954 | Piros et al. | 166/59 X |
| 2,853,136 | 9/1958 | Moore et al. | 166/59 X |
| 2,985,240 | 5/1961 | Emery | 166/59 |
| 2,997,105 | 8/1961 | Campion et al. | 166/59 |
| 3,072,189 | 1/1963 | MacSporran | 166/59 X |
| 3,109,482 | 11/1963 | O'Brien | 166/59 X |
| 3,216,498 | 11/1965 | Palm | 166/59 X |
| 3,315,745 | 4/1967 | Rees, Jr. | 166/59 |
| 3,372,754 | 3/1968 | McDonald | 166/59 |
| 3,456,721 | 7/1969 | Smith | 166/59 |

*Primary Examiner*—Stephen J. Novosad
*Attorney, Agent, or Firm*—Carl G. Ries; Thomas H. Whaley; Theron H. Nichols

[57] ABSTRACT

A method for heating a well or for initiating an in situ combustion operation to recover petroleum from a well in a subterranean reservoir, a method for assembling an ignition system for the in situ combustion, and an ignition system comprises an elongated combustion chamber suspended from a hollow electrical cable which supplies both electrical means and fuel gas to the chamber. Air inlet ducts in the walls of the combustion chamber receive air from the annular space between the hollow cable and the wellbore tubing. An electrical ignitor is temporarily energized to ignite the fuel-air mixture in the air inlet cylinder. An adjacent thermocouple is responsive to a flameout for re-energizing an ignitor manually such that burner operation is interrupted only momentarily .

15 Claims, 5 Drawing Figures

FORMATION INTERVAL WHERE-IN IN SITU COMBUSTION IS INITIATED

METHOD FOR IN SITU COMBUSTION FOR ENHANCED THERMAL RECOVERY OF HYDROCARBONS FROM A WELL AND IGNITION SYSTEM THEREFOR

BACKGROUND OF THE INVENTION

Great improvements in oil recovery are necessary to satisfy the present and future energy requirements of the United States. Thus, improvements are needed in the field of enhanced thermal recovery, such as an improved in situ combustion ignition system for use in heavy oils, tar sands, and oil shale, particularly in deep wells.

Various types of ignition systems have been used and are in use for in situ combustion ignition. Electrical heaters have been used extensively but are limited to 3000 ft or less due to the problem of supplying adequate electrical power to greater depths. The use of gas burning ignition systems becomes more difficult with depth because most designs include a multiplicity of air and gas conduits and electrical cables which complexes the placement of the systems as the depth becomes greater. A recently developed catalytic heater utilizes only a wireline for placement, but has the disadvantage of operating without a temperature monitoring system. Some gas ignition systems have the disadvantage of requiring complete removal from the well and re-running if flameout occurs. This becomes very expensive in rig time alone.

OBJECTS OF THE INVENTION

It is therefore a primary object of this invention to present an ignition system which alleviates these disadvantages and provides an elaborate control system not heretofore practiced in the art.

Accordingly another primary object of this invention is to provide a method for initiating in situ combustion to recover petroleum from a hydrocarbon containing subterranean reservoir in which an air-fuel mixture in a burner having an ignitor and a thermocouple adjacent thereto is ignited when the thermocouple indicates no combustion and the ignitor is extinguished when the thermocouple indicates burning in a combustion chamber to provide a reliable and flame-out proof burner for in situ combustion deep in the well.

Another object of this invention is to provide a method for initiating in situ combustion with a burner in a hydrocarbon containing well including supplying air through an annulus around the fuel conduit and the air-fuel combustion chamber of the burner to the combustion chamber.

A further object of this invention is to provide, a method for initiating in situ combustion with a burner in a hydrocarbon containing well including supplying air from an annulus to the burner air-fuel combustion chamber through a plurality of transverse air ducts in the wall of the combustion chamber for ensuring a highly agitated combustible mixture.

Another primary object of this invention is to provide a method for assembling a downhole burner for an in situ combustion operation to recover petroleum from a well in a subterranean reservoir including particularly the step of interconnecting power means with both an ignitor in the burner and the thermocouple adjacent thereto for energizing the ignitor for igniting the air-fuel combustion mixture in the burner when no combustion is occurring and for de-energizing the ignitor when combustion is occurring in the burner for forming a reliable flame-out proof burner.

Another object of this invention is to provide a method for assembling an ignition system for in situ combustion including particularly the step of forming an air supply annulus around the fuel supply conduit and around the fuel-air combustion chamber of the downhole burner for forming a reliable and flame-out proof burner.

Still another object of this invention is to provide a downhole burner for an in situ combustion operation to recover petroleum from a well in a subterranean reservoir including an ignitor responsive to a thermocouple adjacent thereto for igniting the air-fuel mixture in the combustion chamber of the downhole burner when no combustion is occurring and for being de-energized when combustion is occurring for forming a reliable and flame-out proof burner.

A still further object of this invention is to provide a downhole burner for an in situ combustion operation deep in a well having a hollow cable for supplying fuel gas to a burner with electrical wires embedded in the walls of the cable and centered internally of the wellbore tubing for forming a primary air supply annulus around the hollow cable and around the burner air-fuel combustion chamber and for forming a secondary air supply annulus between the well tubing and the casing for forming an efficient and reliable and flame-out proof burner.

A further object of this invention is to provide a downhole burner for an in situ combustion operation deep in a well that is easy to operate, is of simple configuration, is economical to build and assemble, and is of greater efficiency for the recovery of petroleum from the well in a subterranean reservoir.

Other objects and various advantages of the disclosed method for heating or for in situ combustion to recover petroleum, method for assembling a downhole burner for heating or for in situ combustion, and a burner will be apparent from the following detailed description, together with the accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, one form of the invention.

DESCRIPTION OF THE METHODS

Figure 1:
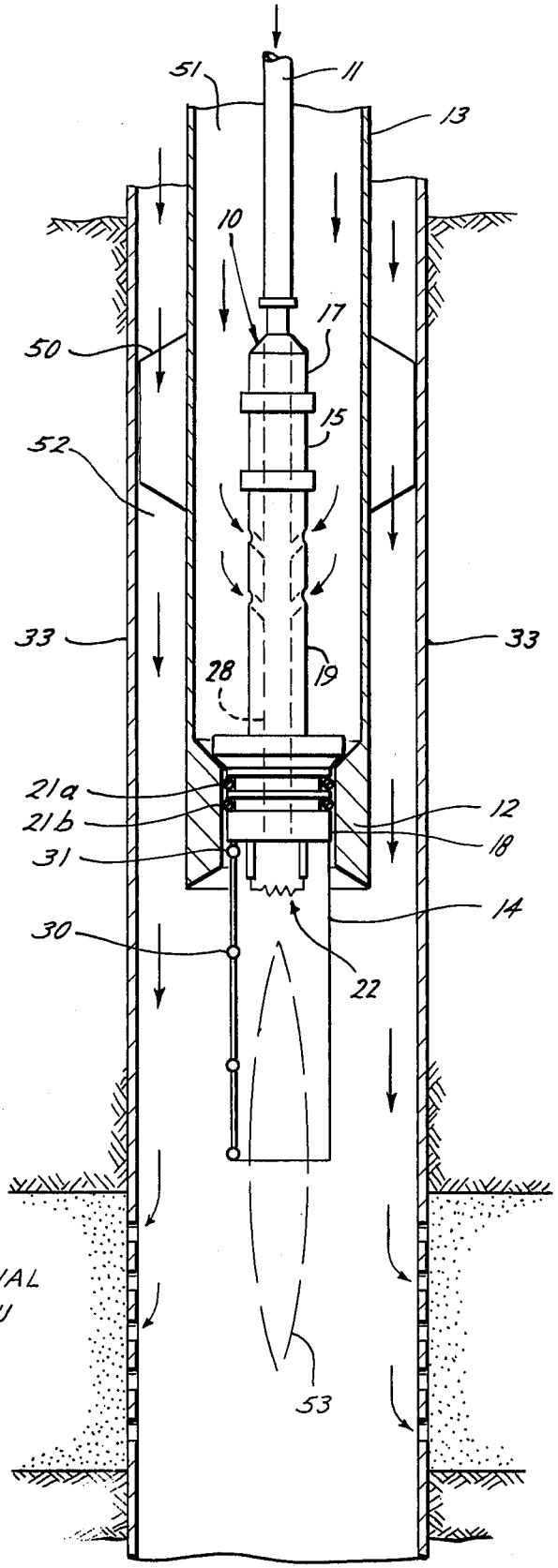
FIG. 1 is a schematic sectional view of the downhole burner for an in situ combustion operation to recover petroleum from a well in a subterranean reservoir for illustrating the method.

This invention comprises a method for heating or for initiating in situ combustion to recover petroleum from a well in a subterranean reservoir, a method for assembling a downhole burner for an in situ combustion operation, and a mechanism for practicing some methods and for being assembled by the other methods.

METHOD FOR IN SITU COMBUSTION TO RECOVER PETROLEUM

A method is set forth for merely heating or for initiating in situ combustion to recover petroleum from a well in a hydrocarbon containing subterranean reservoir comprising the basic steps of, (1) positioning an elongated open ended combustion chamber in the well at the depth of the subterranean reservoir, (2) mounting a thermocouple adjacent an ignitor in the combustion chamber, (3) mixing an air-fuel mixture in the combustion chamber, (4) igniting the air-fuel mixture in the combustion chamber with the ignitor when the thermocouple detects no burning in the combustion chamber and (5) extinguishing the ignitor when burning is occurring in the combustion chamber to provide a reliable and flame-out proof method for heating a well bore for increased production by reducing the viscosity of the petroleum in the reservoir or by initiating in situ combustion deep in a well.

The above basic method may include the following additional steps:

(5) supplying fuel to the combustion chamber from a fuel conduit extending from the surface down to the combustion chamber;

(6) supplying primary air to the combustion chamber through an annulus around the fuel conduit and around the upper end of the combustion chamber, (7) supplying secondary air around the combustion chamber for carrying heat to the reservoir for initiating and propagating in situ combustion, and (8) the step of supplying primary air comprising passing the air through a plurality of transverse air ducts extending from the annulus around the fuel conduit and connected to the combustion chamber for mixing with the fuel from the fuel conduit for ensuring a highly agitated combustible mixture.

METHOD FOR ASSEMBLING A DOWNHOLE BURNER TO RECOVER PETROLEUM

A method for assembling a downhole burner for heating or for an in situ combustion operation to recover petroleum from a well in a subterranean reservoir comprising, (1) forming an elongated combustion chamber open at both ends, (2) mounting an ignitor in the combustion chamber intermediate the ends thereof, (3) forming orifices in the walls of a thick walled cylinder connected to the upper portion of the combustion chamber, (4) extending a downhole fuel supply conduit through the thick walled cylinder down to the open upper end of the elongated combustion chamber, (5) extending a tubing over the thick walled cylinder and fuel supply conduit and connecting said tubing to a lower reduced diameter portion of the thick walled cylinder for forming a downhole primary air supply annulus for the combustion chamber, (6) forming a secondary air supply annulus between the tubing and the well casing for supplying heat to the reservoir, (7) mounting at least one thermocouple in the upper portion of the combustion chamber for sensing excessive heat in the combustion chamber upper portion, (8) mounting at least one thermocouple in the combustion chamber adjacent the ignitor for detecting whether an air-fuel mixture in the combustion chamber is ignited or not ignited, and (9) interconnecting power means with both the ignitor and the thermocouple for energizing the ignitor for igniting the air-fuel mixture in the combustion chamber when no combustion is occurring and for de-energizing the ignitor when combustion is occurring in the air-fuel combustion chamber for providing a reliable and flame-out proof burner for in situ combustion deep in a well.

The above basic method may likewise include the following additional steps:

(10) passing the electrical conduits through the walls of the thick walled air inlet cylinder and embedding the electrical conduits in the walls of the fuel supply conduit;

(11) forming a plurality of transverse air ducts in the elongated cylindrical thick walled cylinder for forming a downhole air supply annulus around the fuel supply conduit for passage of air from the downhole air supply annulus to the air-fuel combustion chamber for ensuring a highly agitated combustible mixture, and

(12) forming the connection between the downhole air supply annulus and the combustion chamber in a detachable connection for being sealed and unsealed.

A DOWNHOLE BURNER FOR HEATING OR FOR INITIATING IN SITU COMBUSTION TO RECOVER PETROLEUM

A downhole burner is disclosed for practicing some of the above methods and for being assembled by some of the other above methods.

While various devices may be utilized for carrying out or practicing the inventive methods and for being assembled by the above methods, FIGS. 1 and 2 illustrate at least one inventive apparatus for practicing the methods described above.

Figure 2A:
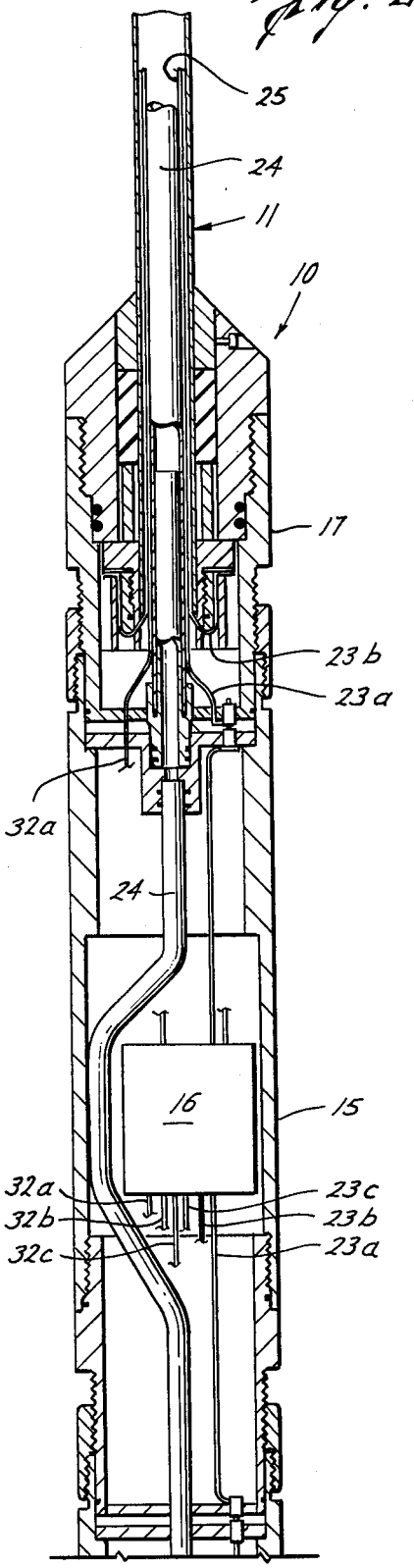
FIG. 2A is a schematic sectional view of the upper portion of the downhole burner.
Figure 2B:
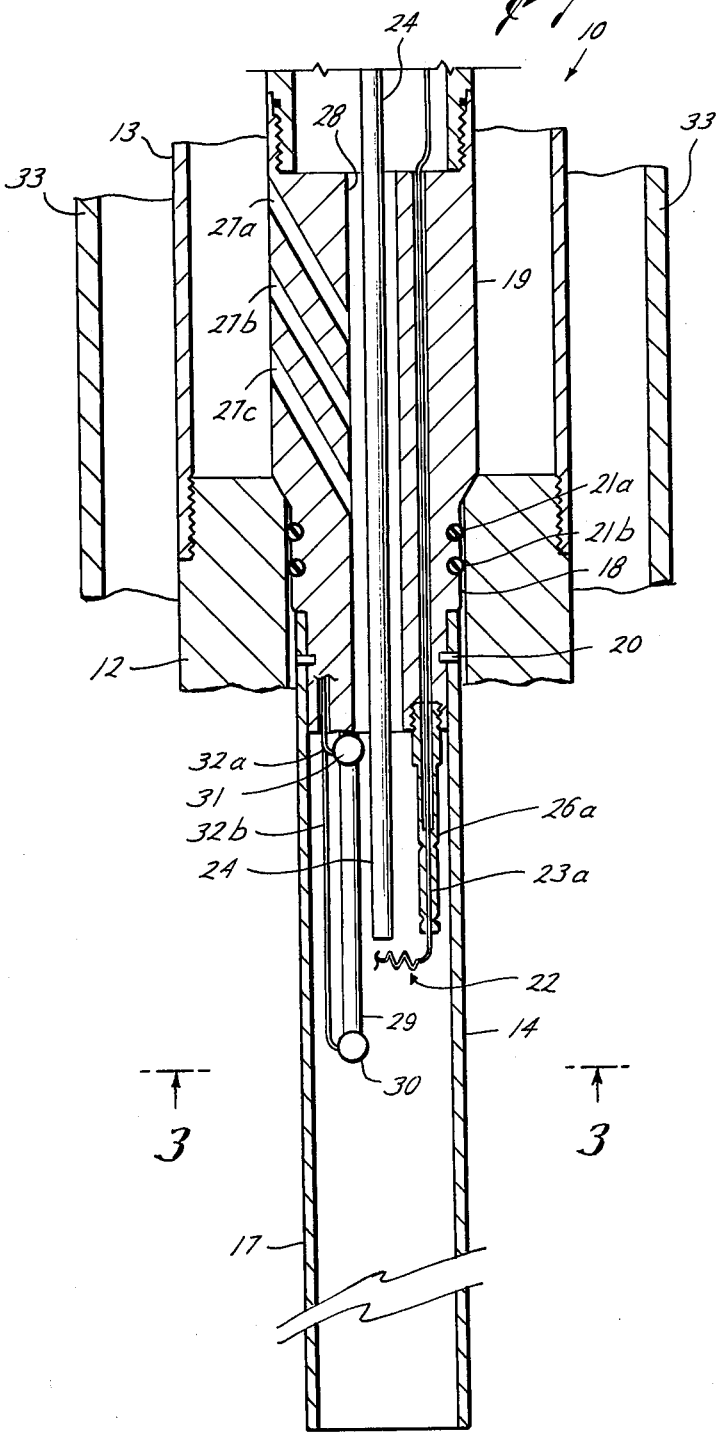
FIG. 2B is a schematic sectional view of the lower portion of the downhole burner.

This gas fired burner 10 is illustrated schematically in FIGS. 1 and in more detail in 2A, and 2B in cross section as being suspended from hollow cable 11, FIGS. 1 and 2A, in the well tubing 13, FIGS. 1 and 2B, the well tubing being centered in and spaced from the well casing 33, with spacers 50, FIG. 1. The gas burner 10 comprises a combustion chamber 14, an air inlet cylinder 19, FIGS. 1 and 2B, and an electrical chamber 15, FIGS. 1 and 2A, having an ignitor relay 16, FIG. 2A, and a hollow cable-electrical and natural gas connecting chamber 17, FIGS. 1 and 2A.

Well tubing 13, FIG. 1 is centered in the well casing 33 with the spacers 50, only two spacers or centralizers being shown for clarity of disclosure. A pump seating nipple 12, FIGS. 1 and 2B, is formed on the internal surface of the well tubing 13 for supporting a liquid pump for producing crude oil, as in a reverse or counter-current flow well, for example. After flow of all liquid petroleum has ceased and heat is desired to reduce the viscosity of the remaining petroleum for increased flow for increased production, the pump is removed and the gas fired burner 10 lowered into well tubing 13 to rest on the pump seating nipple 12 or the lower end of the air inlet cylinder. Seals are provided between a reduced diameter portion 18, FIGS. 1 and 2B, of the thick walled cylinder 19 such as, but not limited to, O-rings 21*a*, 21*b*.

Hollow cable 11, FIG. 1, centered in well tubing 13 forms a primary or combustion air supply annulus duct 51. Well tubing 13 centered in well casing 33 forms a secondary air supply annulus duct 52 in which air is pumped down from the surface in annulus 52 for being heated by the flame 53. Hollow cable 11 per se forms the fuel natural gas supply duct, a fuel supply duct 24 illustrated in FIGS. 2A and 2B being deleted in FIG. 1 for clarity of disclosure.

Figure 3:
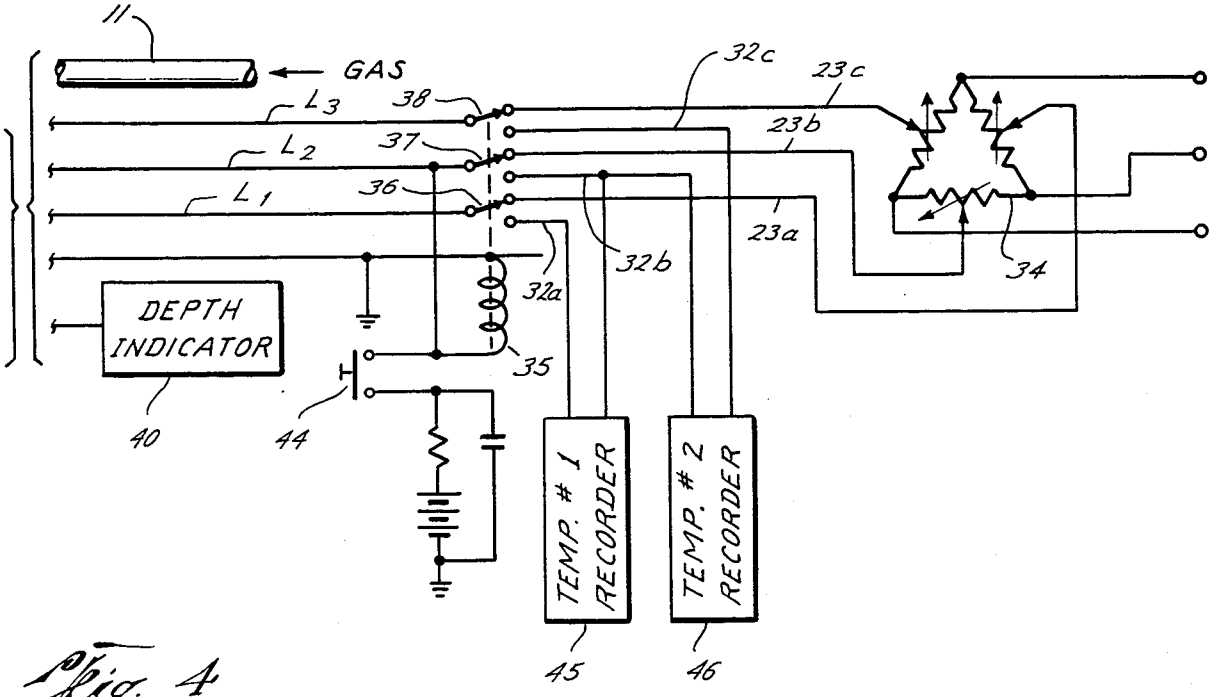
FIG. 3 is a section taken at 3—3 of FIG. 2B.
Figure 3:
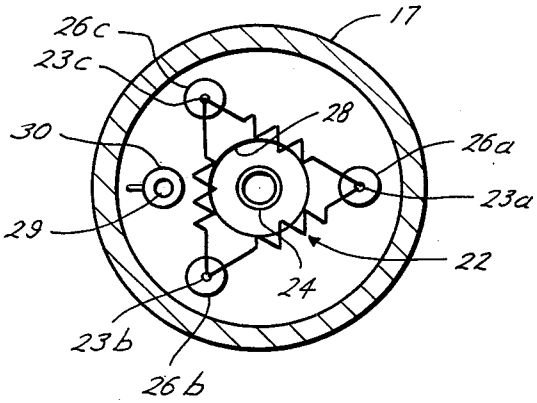
Figure 4:
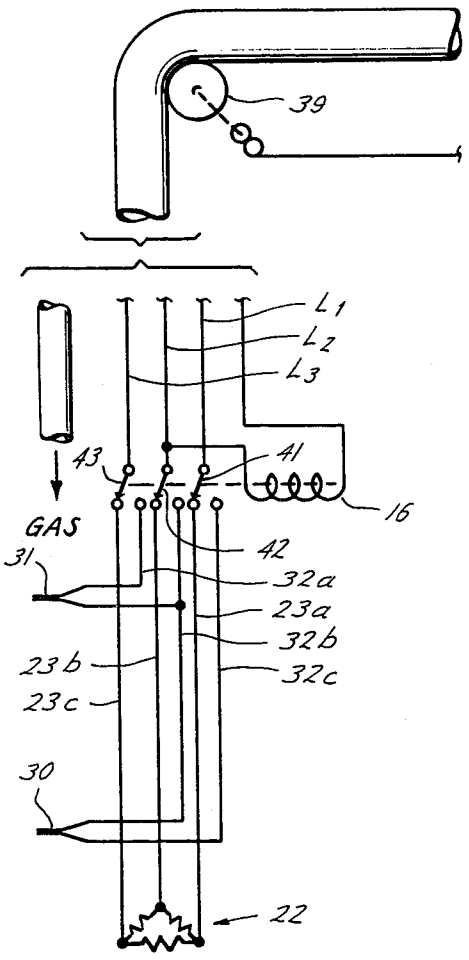
FIG. 4 is a schematic block diagram of the electronics required to ignite and monitor the in situ combustion.

FIGS. 2A and 2B, enlarged vertical sectional schematic views of the burner 10, provide more details thereof. The combustion chamber 14, FIG. 2B, comprises a hollow, open-ended cylinder sheath (such as a ceramic sheath) with one end tightly fitted over the reduced diameter portion 18 of a thick walled air inlet cylinder 19 and secured thereto with pins 20, or the like. The reduced diameter portion 18 fits down inside the pump seating nipple until the burner comes to rest on the beveled portion where the diameter of the thick walled air inlet cylinder 19 increases to full size. An ignitor 22 shown schematically in FIG. 1, actually comprises three nicrome wire heater elements connected in delta as illustrated in FIGS. 3 and 4. Connected to the three intersections of each of the three elements of the ignitor are wires 23*a*, 23*b*, and 23*c*, each wire being in an electrical insulator 26*a*, 26*b*, and 26*c*, respectively, FIG. 3. All three insulators and their respective wires are mounted in the end of the cylinder reduced diameter portion 18, FIG. 2B, which extends internally of the combustion chamber ceramic sheath 14. The wires 23*a*, 23*b*, 23*c*, pass up through the thick walled cylinder, through the relay 16 FIG. 2A in the electrical chamber 15, through the hollow cable-electrical-and natural gas connecting chamber 17, and into the walls of the insulated wire sheathed hollow cable 11 to the surface where they are connected to the burner ignitor control system disclosed hereinafter. The hollow cable 11 is a reelable armored type hose having an armor-wire outer covering, a coiled-spring inner wall stiffener, and at least three separately insulated electrical conductors embedded between two layers of impervious plastic material forming the walls of the hose, such as, but not limited to assignee's U.S. Pat. No. 3,800,870. This hose or cable is capable of withstanding high pressure, particularly in its use for supplying natural gas, or the like, from the surface down to the combustion chamber. Thus the cable carries the necessary electrical wiring for the ignitor and the thermocouples.

Natural gas is supplied directly to the combustion chamber 14, FIGS. 1 and 2B, at the location of the ignitor heater 22 from the gas supply tube or fuel conduit 24, FIG. 2B which extends down through the burner 10 and the hollow cable 11 from a suitable supply (not shown) at the surface.

Primary air for the gas fired burner 10, FIGS. 1 and 2B is pumped down in the annulus 51 formed between the well tubing 13 and the hollow cable 11. As this pressurized air, arrives at the top of the thick walled air inlet cylinder 19, it passes through transverse and downwardly sloping orifices or air inlet ports 27*a*, 27*b*, and 27*c*, FIG. 2B, to a large axial cylindrical duct 28 in the air inlet cylinder 19. This duct 28 has the fuel supply tube 24 FIG. 2B mounted in the center thereof as it traverses the full length of the air inlet cylinder 19 from which the fuel supply tube protrudes a substantial distance to eject the natural gas into the ignitor heater 22. The air from the inlet ports 27*a*, 27*b*, and 27*c*, FIG. 2B, empties into the duct 28 or annulus formed therein by the centered fuel supply tube 24. The pressurized air from these ports is forced down the annulus and, expands into combustion chamber 14 while mixing with the natural gas at ignitor heater 22, FIGS. 1 and 2B, thereby providing a combustible mixture.

A thermocouple support tube 29, FIG. 2B, extends downwardly from the lower end of the air inlet cylinder 19 close to and past the ignitor heater 22. One thermocouple 30 is mounted on thermocouple support tube 29 below the ignitor heater 22 at the end of the support tube and a second thermocouple 31 is mounted on the thermocouple support tube at the base of the tube adjacent the air inlet cylinder 19. Wires 32*a*, 32*b*, and 32*c*, FIG. 4, from the two thermocouples 30 and 31 pass up to the relay 16 of the burner 10. From the relay 16, wires $L_1$, $L_2$, and $L_3$ extend to control relay 35 at the surface.

FIG. 3 is a sectional view at 3—3 on FIG. 2B illustrating the ignitor heater 22 and thermocouple 30 mounted on thermocouple support tube 29 in the combustion chamber ceramic sheath 17.

FIG. 4 illustrates schematically the electrical system for the burner ignition system. Three conductors in the wall of the hollow cable provide current for ignition of the burner followed by temperature monitoring of the burner after ignition has been sustained.

More specifically, a three phase electrical power source 34, FIG. 4, having 3 output leads 23*a*, 23*b*, and 23*c* supplies 208 volt ac 3-phase current, for example, to the three wires $L_1$, $L_2$ and $L_3$ respectively in the walls of the hollow gas supply cable 11 through relay 35 having three, 3 pole, double throw, latching switches 36, 37, and 38.

Relays 16 and 35, FIG. 4, are current pulse activated step relays, such as but not limited to, the series 50 manufactured by Ledex Inc. of Dayton, OH 45402. Capacitor *c* is discharged through the relay coils when push button switch 44 is pressed. Latching switches 36, 37, and 38 of step relay 35 switches electrical lines $L_1$, $L_2$, and $L_3$ between the heater wires 23*a*, 23*b*, and 23*c*, respectively, and the recorder wires 32*a*, 32*b*, and 32*c*, respectively. Cable 11 is lowered over pulley 39, for example, into the well to the desired depth as indicated by the depth indicator 40 and the pump seating nipple 12, FIG. 2B. Relay 35 is connected in parallel with relay 16. Relay 16 down in the burner likewise is illustrated on FIG. 4 having latching switches 41, 42, and 43, for connecting wires $L_1$, $L_2$, and $L_3$ respectively, to either the nicrome wire heater 22 through wires 23*a*, 23*b*, and 23*c* or to the two thermocouples 30 and 31 through wires 32*a*, 32*b*, and 32*c*. Recorders 45 and 46 show instant readouts of the temperatures encountered in the burner 10. Manual push button switch 44 thus may connect the electrical power 34 to the ignitor heater 22 with the relays 16 and 35 set as illustrated in FIG. 4, or it may connect the recorders 45, 46 to the thermocouples 30, and 31 by actuation of the relays to their other position. Thermocouple 30 detects the temperature of the flame below the ignitor while thermocouple 31 detects the temperature of the upper portion of the rest of the ignitor sensitive to excessive heat.

Briefly, in operation, for introducing heat to the formation in order to reduce the viscosity of the petroleum so that it will flow more readily for recovery, the burner 10 is lowered down into the well to rest on the pump seating nipple 12, FIG. 2B, and to be sealed therein by o-rings 21*a*, 21*b*. Natural gas is pumped down at a predetermined pressure through the hollow cable 11 to the combustion chamber 14 while the precise amount of primary air is pumped down the annulus around the hollow cable to inside the combustion chamber to provide an explosive mixture therein. Power source 34, FIG. 4, also at the surface, is then actuated with the manual push button switch 44 and relays 35 and 16 set as illustrated in FIG. 4, to activate the heater ignitor wire coil element 22 for a few seconds to ignite the combustion mixture in the combustion chamber 14, FIG. 2B, deep in the well. After a sufficient time period has lapsed to ensure ignition of the burner 10, push button switch 44 is actuated momentarily for a few seconds. Instantly relays 35 and 16 flip their respective three switches to the other position from that illustrated on FIG. 4 to thereby disconnect the power source 34 from the ignitor 22 and to interconnect the temperature recorders 45 and 46 with their respective thermocouples 30, 31.

After the heater is lighted deep in the well, additional air is required to heat the formation or reservoir. This additional air is pumped down from the surface in larger annulus 52, FIG. 1 between the well tubing 13 and the well casing 33. As this air passes down and around the full length of the heater 14 and a portion of the flame, it becomes very hot. This heated air is then transferred to the formation interval, as illustrated on FIG. 1, and with continued burning, in due course in situ combustion results and is sustained for as long as desired.

Recorder 45 would then be indicating the temperature of combustion in the combustion chamber and recorder 46 would be indicating the temperature at which the upper portion of the burner is being exposed to, as the vulnerable electronic equipment therein. When the combustion chamber temperature drops below combustion temperature, a flame-out is noted immediately and after it is determined that the gas and air supplies are adequate, then the switch 44 is manually actuated or pushed to flip both relays 35 and 16 and their respective 3 switches each to disconnect the recorders 45 and 46 from the thermocouples 30, 31 and to interconnect the power source 34 with the ignitor 22 to relight the burner. After adequate time has lapsed for ignition, the process is repeated by actuating push-button switch 44 again. If too high a temperature is recorded on recorder 46 from thermocouple 31 indicating the electrical portion of the burner may be approaching a too high or critical temperature, the air velocity in annulus 51 is increased for cooling of the burner.

As a modification, automatic operation may be obtained by making the switch 44 responsive to a predetermined low temperature in thermocouple 30 for switching power to the ignitor burner for a predetermined period of time. Similarily secondary air and fuel is automatically increased for cooling when thermocouple 31 senses too high a temperature.

Obviously other methods may be utilized for heating and for initiating in situ combustion and for assembling a downhole burner and other embodiments than that of FIG. 1, may be utilized, depending on the particular subsurface lithology or petrography at the various depths.

Accordingly, it will be seen that the production of hydrocarbons from a subterranean hydrocarbon-bearing formation is stimulated by the above methods and by the above downhole burner, and the disclosed burner will operate in a manner which meets each of the objects set forth hereinbefore.

While the above disclosed burner is described for use in a producing wellbore in a counter-current in situ combustion process, it may also be used in an air injection wellbore for a forward in situ combustion process.

While only two methods of the invention and one mechanism for carrying out the methods have been disclosed, it will be evident that various other methods and modifications are possible in the arrangement and construction of the disclosed methods and systems without departing from the scope of the invention and it is accordingly desired to comprehend with the purview of this invention such modifications as may be considered to fall within the scope of the appended claims.

We claim:

1. A method for initiating heat in one of two wells in a subterranean reservoir for recovering petroleum from at least one of the wells comprising, (a) positioning an elongated open ended combustion chamber in one of the wells at the depth of the subterranean reservoir, (b) mounting a thermocouple adjacent an ignitor in the combustion chamber, (c) connecting electrical conduits to both the ignitor and the thermocouple, (d) embedding the ignitor and thermocouple electrical conduits in the walls of an air inlet cylinder and in the walls of a fuel supply conduit, (e) mixing an air-fuel mixture in the combustion chamber of air from the air inlet cylinder and fuel from the fuel supply conduit, (f) igniting the air-fuel mixture in the combustion chamber with the ignitor when the thermocouple detects no burning in the combustion chamber, and (g) extinguishing the ignitor when the thermocouple detects burning in the combustion chamber to provide a reliable and flame-out proof method for initiating heat deep in the one well.

2. A method for initiating in situ combustion in one of two wells in a subterranean reservoir for recovering petroleum from at least one of the wells comprising, (a) positioning an elongated open ended combustion chamber means in one of the wells at the depth of the subterranean reservoir, (b) mounting a thermocouple adjacent an ignitor in the combustion chamber means, (c) mixing an air-fuel mixture in the combustion chamber of air from an air inlet cylinder mounted on the combustion chamber means and fuel from a fuel supply conduit, (d) forming the connection between the air inlet cylinder and the combustion chamber means in a detachable connection for being sealed and unsealed, (e) igniting the air-fuel mixture in the combustion chamber means with the ignitor when the thermocouple detects no burning in the combustion chamber means, and (f) extinguishing the ignitor when burning is occurring in the combustion chamber means to provide a reliable and flame-out proof method for initiating in situ combustion deep in the one well.

3. A method as recited in claim 2 comprising further, (a) supplying fuel to the combustion chamber from the fuel supply conduit extending from the surface down to the combustion chamber means, (b) supplying primary air to the combustion chamber means through an annulus formed internally of the air inlet cylinder around the fuel conduit to the combustion chamber, and (c) supplying secondary air around the combustion chamber means for carrying heat to the reservoir for initiating and propagating in situ combustion.

4. A method as recited in claim 3 wherein, (a) the step of supplying air from the annulus to the combustion chamber means comprising passing the air through a plurality of transverse air ducts extending transversely through the air inlet cylinder wall for passing from a passage externally of the air inlet cylinder to the annulus internally of the air inlet cylinder for ensuring a highly agitated combustible mixture.

5. A method for assembling a downhole burner for an in situ combustion operation in one of two wells in a subterranean reservoir for recovering petroleum from at least one of the wells comprising, (a) forming an elongated combustion chamber means open at both ends, (b) mounting an ignitor in the combustion chamber means intermediate the ends thereof, (c) forming orifices in the walls of an air inlet cylinder connected to the upper end of the combustion chamber means, (d) extending a downhole fuel supply conduit to the open upper end of the elongated combustion chamber means internally of the air inlet cylinder for forming an air inlet annulus around the fuel supply conduit, (e) extending a tubing around the air inlet cylinder and connecting said tubing to the air inlet cylinder for forming a downhole air supply annulus for the combustion chamber means, (f) forming a secondary air supply annulus between the tubing and the well casing for supplying heat to the reservoir, (g) mounting at least one thermocouple in the combustion chamber means adjacent the ignitor for detecting whether an air-fuel mixture in the combustion chamber means is ignited or not ignited, and (h) interconnecting power means with both the ignitor and the thermocouple for energizing the ignitor for igniting the air-fuel mixture in the combustion chamber means when no combustion is occurring and for de-energizing the ignitor when combustion is occurring in the air-fuel combustion chamber means for providing a reliable and flameout proof burner for in situ combustion deep in the one well.

6. A method as recited in claim 5 comprising further, (a) connecting electrical conduits to both the ignitor and the thermocouple, and (b) embedding the electrical conduits in the walls of the air inlet cylinder and on the walls of the fuel supply conduit.

7. A method as recited in claim 5 comprising further, (a) forming the connection between the air inlet cylinder and the well tubing in a detachable connection for being sealed and unsealed.

8. A downhole burner for an in situ combustion operation in one of two wells in a subterranean reservoir for recovering petroleum from at least one of the wells comprising, (a) air-fuel combustion chamber means for receiving an air-fuel mixture positionable in one of the wells at the depth of the desired in situ combustion in the subterranean reservoir, (b) downhole fuel supply conduit means extending down into the well to said combustion chamber means, (c) downhole annular air supply means around said fuel supply means and around an upper portion of said combustion chamber means for supplying air to said combustion chamber means, (d) said combustion chamber means being detachably connected to said downhole annular air supply means, (e) ignitor means in said combustion chamber means having an electrical conduit to the surface for igniting said air-fuel mixture therein, (f) thermocouple means in said combustion chamber means having an electrical conduit to the surface for detecting whether said air-fuel combustion chamber means is ignited or not ignited, and (g) said ignitor means being energized for igniting said air-fuel mixture in said combustion chamber means when no combustion is occurring and for being de-energized when combustion is occurring in said air-fuel combustion chamber means for forming a reliable and flame-out proof burner for in situ combustion deep in the one well.

9. A downhole burner as recited in claim 8 wherein, (a) said electrical conduits are mounted on the walls of both said fuel supply conduit means and said annular air supply means means for energizing said thermocouple means and said ignitor means.

10. A downhole burner as recited in claim 9 wherein, (a) each of said ignitor electrical conduit and said thermocouple electrical conduit is embedded in the walls of both said fuel supply means and said air inlet cylinder.

11. A downhole burner as recited in claim 8 comprising further, (a) a thick walled air inlet chamber means mounted on top of said combustion chamber means around said fuel supply conduit means having a plurality of transverse ducts therein said thick wall for receiving air from said downhole annular air supply means for ensuring a highly agitated combustible mixture.

12. A downholeburner for an in situ combustion operation in one of two wells in a subterranean reservoir for recovering petroleum from at least one of the wells comprising, (a) an air-fuel elongated combustion chamber means for receiving an air-fuel mixture positionable in one of the wells at the depth of the desired in situ combustion in the subterranean reservoir, (b) a downhole fuel supply conduit extending from a fuel supply means on the surface down in the one well to connect to said air-fuel combustion chamber, (c) a tube extending from an air supply means on the surface down and around said downhole fuel supply conduit and a portion of said air-fuel combustion chamber means forming a downhole air supply annulus for supplying air to said air-fuel combustion chamber means, (d) ignitor means mounted in said air-fuel combustion chamber means having an electrical conduit to the surface for igniting said air-fuel mixture therein, (e) thermocouple means mounted in said air-fuel combustion chamber means having an electrical conduit to the surface for detecting whether said air-fuel combustion chamber means is ignited or not ignited, (f) both said ignitor and thermocouple electrical conduits being embedded in the walls of said air inlet cylinder and said fuel supply conduit, and (g) said ignitor means being energized for igniting said air-fuel mixture in said combustion chamber means when no combustion is occurring and for being de-energized when combustion is occurring in said air-fuel combustion chamber means for providing a reliable and flame-out proof burner for in situ combustion deep in the one well.

13. A downhole burner as recited in claim 12 wherein, (a) said downhole air supply tube is detachably connected to said air-fuel combustion chamber for being sealed and unsealed therewith.

14. A downhole burner as recited in claim 12 wherein, (a) a thick walled air inlet chamber means mounted on top of said combustion chamber means around said downhole fuel supply conduit and having a plurality of transverse ducts in the walls thereof formed at an angle of less than a right angle to the longitudinal axis of said downhole fuel supply conduit for passing air from said downhole air supply annulus to said air-fuel combustion chamber for ensuring a highly agitated combustible mixture.

15. A downhole burner as recited in claim 12 comprising further, (a) annular means formed between said air supply tube and a well casing for supplying secondary air for transferring heat from the combustion chamber means to the subterranean reservoir, (b) second thermocouple means mounted in the upper portion of said combustion chamber means for detecting excessive heat in said upper portion, and (c) said air supply tube comprising means for increasing the flow of secondary air in said annular means for increased cooling of said combustion chamber upper portion when said second thermocouple means detects any excessive heat therein.

* * * * *